US010499162B2

(12) United States Patent
Dupuis et al.

(10) Patent No.: US 10,499,162 B2
(45) Date of Patent: Dec. 3, 2019

(54) ACTIVE BIAS OF MICROPHONE WITH VARIABLE BIAS RESISTANCE

(71) Applicant: Cirrus Logic International Semiconductor Ltd., Edinburgh (GB)

(72) Inventors: Timothy J. Dupuis, West Lake Hills, TX (US); Vivek Saraf, Austin, TX (US); Axel Thomsen, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 15/940,033

(22) Filed: Mar. 29, 2018

(65) Prior Publication Data

US 2019/0306632 A1 Oct. 3, 2019

(51) Int. Cl.
*H04R 19/04* (2006.01)
*H04R 3/00* (2006.01)

(52) U.S. Cl.
CPC ..... *H04R 19/04* (2013.01); *H04R 3/00* (2013.01); *H04R 2201/003* (2013.01)

(58) Field of Classification Search
None
See application file for complete search history.

(56) References Cited

U.S. PATENT DOCUMENTS

| | | | | |
|---|---|---|---|---|
| 8,581,356 | B2 | 11/2013 | Pennock | |
| 2012/0043974 | A1 | 2/2012 | van den Boom et al. | |
| 2013/0051582 | A1* | 2/2013 | Kropfitsch | H03F 1/56 381/111 |
| 2013/0266156 | A1* | 10/2013 | Frohlich | H03F 1/34 381/120 |
| 2017/0359036 | A1* | 12/2017 | Frohlich | H03F 3/04 |

* cited by examiner

*Primary Examiner* — James K Mooney
(74) *Attorney, Agent, or Firm* — Jackson Walker L.L.P.

(57) ABSTRACT

A bias circuit for a capacitive sensor may include a variable impedance element coupled to a capacitor of the capacitive sensor wherein an impedance of the variable impedance element is varied in accordance with a temperature associated with the bias circuit and an active feedback circuit coupled between the variable impedance element and an output of a processing circuit for processing a signal generated by the capacitive sensor and configured to drive the variable impedance element to force a direct-current (DC) voltage level of an output of the capacitive sensor to a desired voltage.

15 Claims, 4 Drawing Sheets

ACTIVE BIAS OF MICROPHONE WITH VARIABLE BIAS RESISTANCE

FIELD OF DISCLOSURE

The present disclosure relates in general to audio systems, and more particularly, to biasing a microphone for operation.

BACKGROUND

Microphones are ubiquitous on many devices used by individuals, including computers, tablets, smart phones, and many other consumer devices. Generally speaking, a microphone is an electroacoustic transducer that produces an electrical signal in response to deflection of a portion (e.g., a membrane or other structure) of a microphone caused by sound incident upon the microphone. To process audio signals generated by a microphone, microphones are often coupled to an audio system. However, many traditional audio system topologies may have disadvantages, as is illustrated with reference to FIG. 1.

FIG. 1 illustrates a block diagram of selected components of an example audio system 100, as is known in the art. As shown in FIG. 1, audio system 100 may include an analog signal path portion comprising bias voltage source 102, a microphone transducer 104, bias resistor 107, analog pre-amplifier 108, and a digital path portion comprising an analog-to-digital converter (ADC) 110, a driver 112, and a digital audio processor 114.

Bias voltage source 102 may comprise any suitable system, device, or apparatus configured to supply microphone transducer 104 with a direct-current bias voltage VBIAS, such that microphone transducer 104 may generate an electrical audio signal. Microphone transducer 104 may comprise any suitable system, device, or apparatus configured to convert sound incident at microphone transducer 104 to an electrical signal, wherein such sound is converted to an electrical analog input signal using a diaphragm or membrane having an electrical capacitance (modeled as variable capacitor 106 in FIG. 1) that varies as based on sonic vibrations received at the diaphragm or membrane. Microphone transducer 104 may include an electrostatic microphone, a condenser microphone, an electret microphone, a microelectromechanical systems (MEMs) microphone, or any other suitable capacitive microphone. As shown in FIG. 1, the bias circuit for microphone transducer 104 may also include bias resistor 107 coupled between microphone transducer 104 and a ground voltage.

Pre-amplifier 108 may receive the analog input signal output from microphone transducer 104 and may comprise any suitable system, device, or apparatus configured to condition the analog audio signal for processing by ADC 110.

ADC 110 may receive a pre-amplified analog audio signal output from pre-amplifier 108, and may comprise any suitable system, device, or apparatus configured to convert the pre-amplified analog audio signal received at its input to a digital signal representative of the analog audio signal generated by microphone transducer 104. ADC 110 may itself include one or more components (e.g., delta-sigma modulator, decimator, etc.) for carrying out the functionality of ADC 110. Driver 112 may receive the digital signal output by ADC 110 and may comprise any suitable system, device, or apparatus configured to condition such digital signal (e.g., encoding into Audio Engineering Society/European Broadcasting Union (AES/EBU), Sony/Philips Digital Interface Format (S/PDIF), or other suitable audio interface standards), in the process generating a digitized microphone signal for transmission over a bus to digital audio processor 114.

Once converted to the digitized microphone signal, the digitized microphone signal may be transmitted over significantly longer distances without being susceptible to noise as compared to an analog transmission over the same distance. In some embodiments, one or more of bias voltage source 102, pre-amplifier 108, ADC 110, and driver 112 may be disposed in close proximity with microphone transducer 104 to ensure that the lengths of the analog signal transmission lines are relatively short to minimize the amount of noise that can be picked up on such analog output lines carrying analog signals. For example, in some embodiments, one or more of bias voltage source 102, microphone transducer 104, pre-amplifier 108, ADC 110, and driver 112 may be formed on the same integrated circuit die or substrate.

Digital audio processor 114 may comprise any suitable system, device, or apparatus configured to process the digitized microphone signal for use in a digital audio system. For example, digital audio processor 114 may comprise a microprocessor, microcontroller, digital signal processor (DSP), application specific integrated circuit (ASIC), or any other device configured to interpret and/or execute program instructions and/or process data, such as the digitized microphone signal output by driver 112.

Despite the various advantages of digital microphone systems such as those shown in FIG. 1, such digital microphone systems may have disadvantages. For example, bias resistor 107 is often implemented using a back-to-back poly diode resistor. Such poly diode resistors are often susceptible to a tremendous variation with temperature, sometimes on the order of magnitude of a factor of 1000. For example, an example poly diode resistor may have a resistance of 26 TΩ at −20° C., a resistance of 800 GΩ at 25° C., and a resistance of 25 GΩ at 75° C. Because the bias resistance is so high, especially at low temperatures, even extremely small leakage currents may result in a direct-current (DC) offset voltage at the input to pre-amplifier 108, which may in turn lead to loss of measurement sensitivity, amplifier overload, and other negative effects.

One existing solution to overcome these disadvantages has been to include, interfaced between microphone transducer 104 and pre-amplifier 108, a high-pass filter to filter out such negative characteristics. However, such high-pass filters may reduce leakage-induced DC offsets that cause amplifier overload, but do not help with the problem of microphone sensitivity change caused by leakage. In addition, such high-pass filters may introduce extra noise in the system and have settling transients.

SUMMARY

In accordance with the teachings of the present disclosure, certain disadvantages and problems associated with existing audio systems including microphones may be reduced or eliminated.

In accordance with embodiments of the present disclosure, a bias circuit for a capacitive sensor may include a variable impedance element coupled to a capacitor of the capacitive sensor wherein an impedance of the variable impedance element is varied in accordance with a temperature associated with the bias circuit and an active feedback circuit coupled between the variable impedance element and an output of a processing circuit for processing a signal generated by the capacitive sensor and configured to drive the variable impedance element to force a direct-current (DC) voltage level of an output of the capacitive sensor to a desired voltage.

In accordance with these and other embodiments of the present disclosure, a method may include varying, in accordance with a temperature associated with the bias circuit, an impedance of a variable impedance element coupled to a capacitor of a capacitive sensor, wherein the variable impedance element is integral to the bias circuit for biasing the capacitive sensor and driving the variable impedance element with an active feedback circuit coupled between the variable impedance element and an output of a processing circuit for processing a signal generated by the capacitive sensor in order to force a direct-current (DC) voltage level of an output of the capacitive sensor to a desired voltage.

In accordance with these and other embodiments of the present disclosure, an integrated circuit may include a capacitive sensor configured to vary a capacitance of the capacitive sensor in conformity with a measured physical quantity, a processing circuit for processing a signal generated by the capacitive sensor representative of the capacitance, and a bias circuit for electrically biasing the capacitive sensor, the bias circuit comprising a variable impedance element coupled to a capacitor of the capacitive sensor wherein an impedance of the variable impedance element is varied in accordance with a temperature associated with the bias circuit and an active feedback circuit coupled between the variable impedance element and an output of the processing circuit and configured to drive the variable impedance element to force a direct-current (DC) voltage level of an output of the capacitive sensor to a desired voltage.

Technical advantages of the present disclosure may be readily apparent to one having ordinary skill in the art from the figures, description and claims included herein. The objects and advantages of the embodiments will be realized and achieved at least by the elements, features, and combinations particularly pointed out in the claims.

It is to be understood that both the foregoing general description and the following detailed description are explanatory examples and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 1:
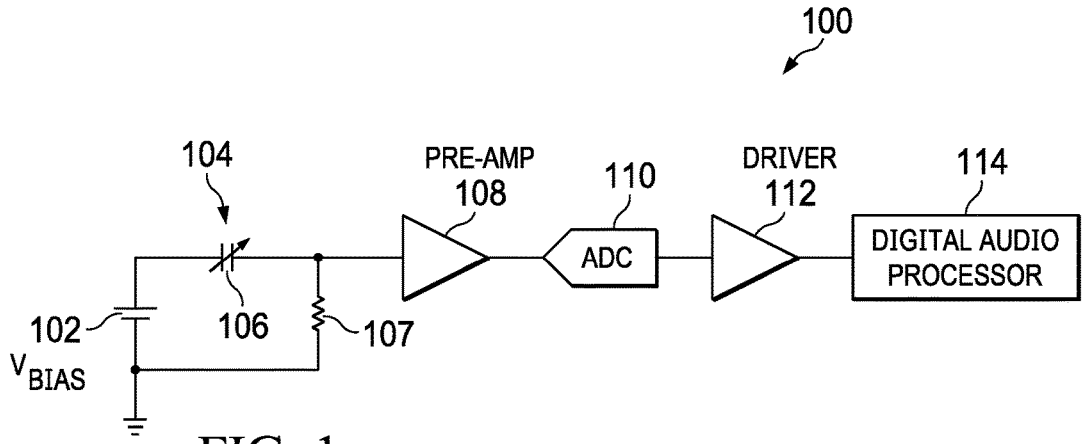
FIG. 1 (PRIOR ART)
FIG. 1 illustrates a block diagram of selected components of an example audio system, as is known in the art.
Figure 2A:
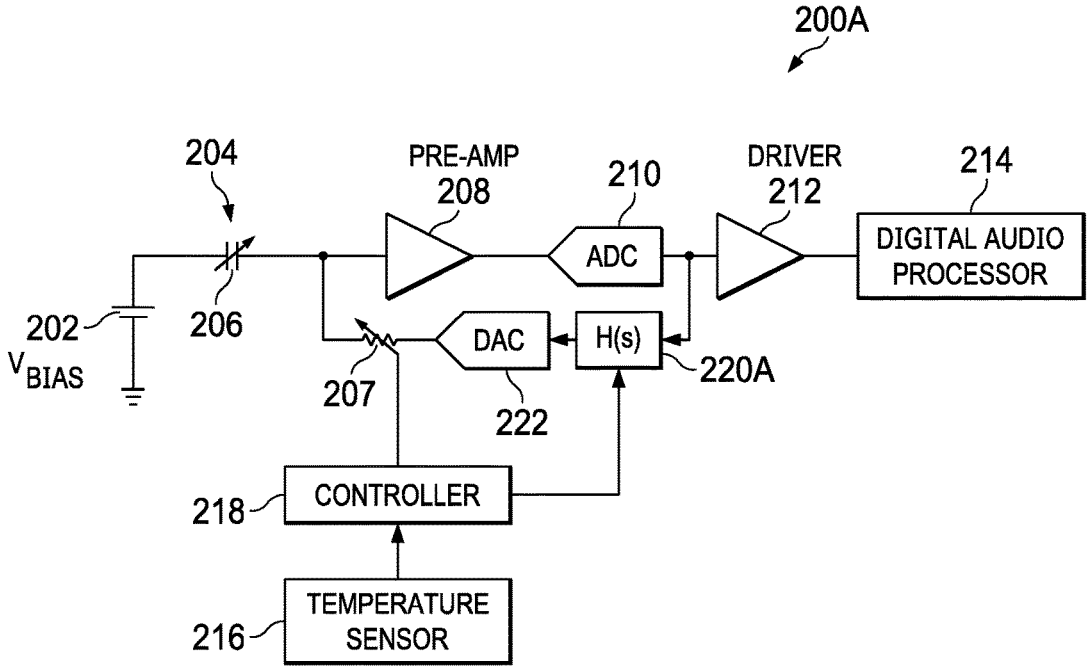
FIG. 2A illustrates a block diagram of selected components of an example audio system using a digital microphone, in accordance with embodiments of the present disclosure.

FIG. 2A illustrates a block diagram of selected components of an example audio system 200A using a digital microphone, in accordance with embodiments of the present disclosure. As shown in FIG. 2A, audio system 200A may include an analog signal path portion comprising bias voltage source 202, a microphone transducer 204, variable bias resistor 207, analog pre-amplifier 208, a digital path portion comprising an analog-to-digital converter (ADC) 210, a driver 212, a digital audio processor 214, a temperature sensor 216, a controller 218, a feedback filter 220A, and a digital-to-analog converter 222.

Bias voltage source 202 may comprise any suitable system, device, or apparatus configured to supply microphone transducer 204 with a direct-current bias voltage VBIAS, such that microphone transducer 204 may generate an electrical audio signal. Microphone transducer 204 may comprise any suitable system, device, or apparatus configured to convert sound incident at microphone transducer 204 to an electrical signal, wherein such sound is converted to an electrical analog input signal using a diaphragm or membrane having an electrical capacitance (modeled as variable capacitor 206 in FIG. 2A) that varies as based on sonic vibrations received at the diaphragm or membrane. Microphone transducer 204 may include an electrostatic microphone, a condenser microphone, an electret microphone, a microelectromechanical systems (MEMs) microphone, or any other suitable capacitive microphone. A bias circuit for microphone transducer 204 may also include variable bias resistor 207 coupled between microphone transducer 204 and the output of a feedback path comprising feedback filter 220A and DAC 222, as shown in FIG. 2A.

Pre-amplifier 208 may receive the analog input signal output from microphone transducer 204 and may comprise any suitable system, device, or apparatus configured to condition the analog audio signal for processing by ADC 210.

ADC 210 may receive a pre-amplified analog audio signal output from pre-amplifier 208, and may comprise any suitable system, device, or apparatus configured to convert the pre-amplified analog audio signal received at its input to a digital signal representative of the analog audio signal generated by microphone transducer 204. ADC 210 may itself include one or more components (e.g., delta-sigma modulator, decimator, etc.) for carrying out the functionality of ADC 210. Driver 212 may receive the digital signal output by ADC 210 and may comprise any suitable system, device, or apparatus configured to condition such digital signal (e.g., encoding into Audio Engineering Society/European Broadcasting Union (AES/EBU), Sony/Philips Digital Interface Format (S/PDIF), or other suitable audio interface standards), in the process generating a digitized microphone signal for transmission over a bus to digital audio processor 214.

Once converted to the digitized microphone signal, the digitized microphone signal may be transmitted over significantly longer distances without being susceptible to noise as compared to an analog transmission over the same distance. In some embodiments, one or more of bias voltage source 202, pre-amplifier 208, ADC 210, and driver 212 may be disposed in close proximity with microphone transducer 204 to ensure that the lengths of the analog signal transmission lines are relatively short to minimize the amount of noise that can be picked up on such analog output lines carrying analog signals. For example, in some embodiments, one or more of bias voltage source 202, microphone transducer 204, pre-amplifier 208, ADC 210, and driver 212 may be formed on the same integrated circuit die or substrate.

Digital audio processor 214 may comprise any suitable system, device, or apparatus configured to process the digitized microphone signal for use in a digital audio system. For example, digital audio processor 214 may comprise a microprocessor, microcontroller, digital signal processor (DSP), application specific integrated circuit (ASIC), or any other device configured to interpret and/or execute program instructions and/or process data, such as the digitized microphone signal output by driver 212.

Feedback filter 220A may comprise any suitable system, device, or apparatus configured to apply a filter response H(s) to the digital signal output by ADC 210. As shown in FIG. 2A, such filtered response H(s) may be controlled by a control signal received from controller 218.

DAC 222 may receive a filtered digital audio feedback signal output from feedback filter 220A, and may comprise any suitable system, device, or apparatus configured to convert the filtered digital audio feedback signal received at its input to an equivalent analog signal. DAC 222 may itself include one or more components (e.g., delta-sigma modulator, decimator, etc.) for carrying out the functionality of DAC 222. Such filtered analog audio feedback signal may drive variable bias resistor 207.

Temperature sensor 216 may comprise any system, device, or apparatus (e.g., a thermometer, thermistor, etc.) configured to communicate a signal to controller 218 indicative of a temperature proximate to or otherwise associated with the bias circuit of audio system 200A, or a temperature associated with another portion of audio system 200A.

Controller 218 may comprise any system, device, or apparatus (e.g., processor, microcontroller, field programmable gate array, application-specific integrated circuit, etc.) configured to receive a temperature signal from temperature sensor 216 indicative of a temperature associated with the bias circuit or another portion of audio system 200A, and vary the resistance of variable bias resistor 207 in accordance with the measured temperature. For example, controller 218 may cause an increase in a nominal resistance of variable bias resistor 207 responsive to increasing temperatures and cause a decrease in a nominal resistance of variable bias resistor 207 responsive to decreasing temperatures, so as to compensate for variance of the actual resistance of variable bias resistor 207 due to changes in temperature.

As arranged as shown in FIG. 2A, variable bias resistor 207 is driven by an active feedback network comprising feedback filter 220A and DAC 222, wherein the active feedback network is configured to drive variable bias resistor 207 to force a direct-current (DC) voltage level of an output (e.g., the electrical node common to microphone transducer 206 and variable bias resistor 207) of microphone transducer 204 to a desired voltage.

Figure 2B:
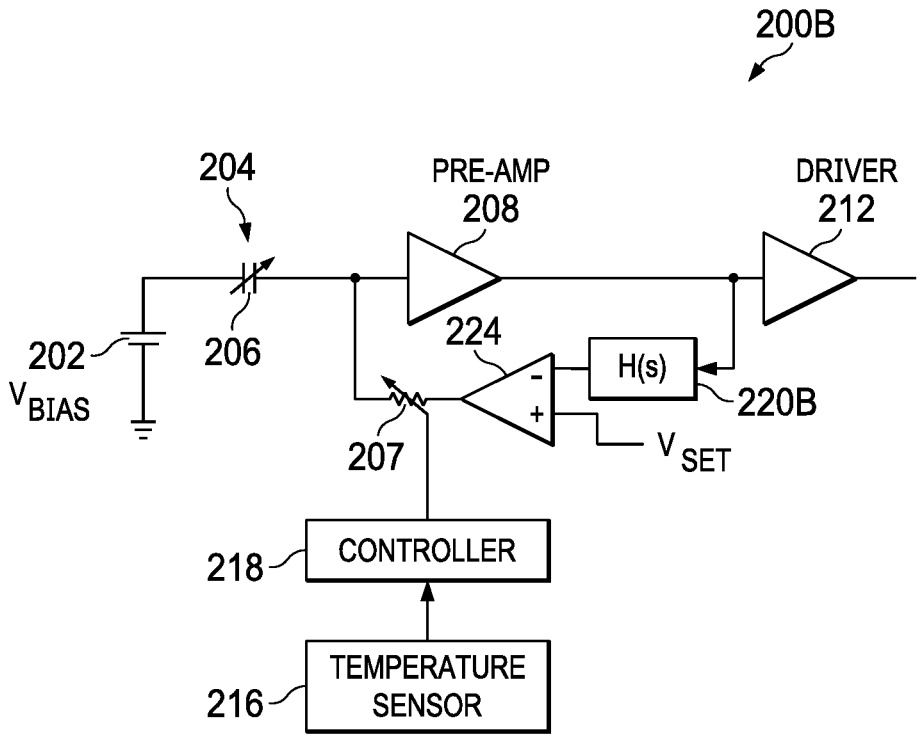
FIG. 2B illustrates a block diagram of selected components of an example audio system using an analog microphone, in accordance with embodiments of the present disclosure.

FIG. 2B illustrates a block diagram of selected components of an example audio system 200B using an analog microphone, in accordance with embodiments of the present disclosure. As shown in FIG. 2B, audio system 200B may include bias voltage source 202, a microphone transducer 204, variable bias resistor 207, analog pre-amplifier 208, a driver 212, a temperature sensor 216, a controller 218, a feedback filter 220B, and a comparator 224.

Bias voltage source 202 may comprise any suitable system, device, or apparatus configured to supply microphone transducer 204 with a direct-current bias voltage VBIAS, such that microphone transducer 204 may generate an electrical audio signal. Microphone transducer 204 may comprise any suitable system, device, or apparatus configured to convert sound incident at microphone transducer 204 to an electrical signal, wherein such sound is converted to an electrical analog input signal using a diaphragm or membrane having an electrical capacitance (modeled as variable capacitor 206 in FIG. 2B) that varies as based on sonic vibrations received at the diaphragm or membrane. Microphone transducer 204 may include an electrostatic microphone, a condenser microphone, an electret microphone, a microelectromechanical systems (MEMs) microphone, or any other suitable capacitive microphone. A bias circuit for microphone transducer 204 may also include variable bias resistor 207 coupled between microphone transducer 204 and the output of a feedback path comprising feedback filter 220B and comparator 224, as shown in FIG. 2B.

Pre-amplifier 208 may receive the analog input signal output from microphone transducer 204 and may comprise any suitable system, device, or apparatus configured to condition the analog audio signal for driver 212. Driver 212 may receive the analog signal output by pre-amplifier 208 and may comprise any suitable system, device, or apparatus configured to condition such analog signal, in the process generating an analog microphone signal for transmission over a bus.

Feedback filter 220B may comprise any suitable system, device, or apparatus configured to apply a filter response H(s) to the analog signal output by pre-amplifier 209. As shown in FIG. 2B, such filtered response H(s) may be controlled by a control signal received from controller 218.

Amplifier 224 may receive a filtered analog audio feedback signal output from feedback filter 220B, and may comprise any suitable system, device, or apparatus configured to generate a driving signal to drive variable bias resistor 207 based on a difference between the filtered analog audio feedback signal and a setpoint voltage VSET.

Temperature sensor 216 may comprise any system, device, or apparatus (e.g., a thermometer, thermistor, etc.) configured to communicate a signal to controller 218 indicative of a temperature proximate to or otherwise associated with the bias circuit of audio system 200B, or a temperature associated with another portion of audio system 200B.

Controller 218 may comprise any system, device, or apparatus (e.g., processor, microcontroller, field programmable gate array, application-specific integrated circuit, etc.) configured to receive a temperature signal from temperature sensor 216 indicative of a temperature associated with the bias circuit or another portion of audio system 200B, and vary the resistance of variable bias resistor 207 in accordance with the measured temperature. For example, controller 218 may cause an increase in a nominal resistance of variable bias resistor 207 responsive to increasing temperatures and cause a decrease in a nominal resistance of variable bias resistor 207 responsive to decreasing temperatures, so as to compensate for variance of the actual resistance of variable bias resistor 207 due to changes in temperature.

As arranged as shown in FIG. 2B, variable bias resistor 207 is driven by an active feedback network comprising feedback filter 220B and comparator 224, wherein the active feedback network is configured to drive variable bias resistor 207 to force a direct-current (DC) voltage level of an output (e.g., the electrical node common to microphone transducer 206 and variable bias resistor 207) of microphone transducer 204 to a desired voltage.

Figure 3:
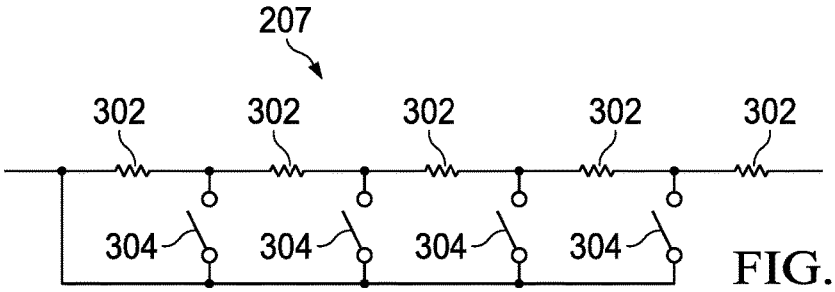
FIG. 3 illustrates a circuit diagram of selected components of the variable bias resistor depicted in FIGS. 2A and 2B, in accordance with embodiments of the present disclosure.

FIG. 3 illustrates a circuit diagram of selected components of variable bias resistor 207 depicted in FIGS. 2A and 2B, in accordance with embodiments of the present disclosure. As shown in FIG. 3, variable bias resistor 207 may comprise a plurality of switched resistor elements 302 and a plurality of bypass switches 304, wherein the resistance of variable bias resistor 207 may be selected by selectively controlling (e.g., by control signals communicated from controller 218 responsive to a sensed temperature) bypass switches 304.

Figure 4A:
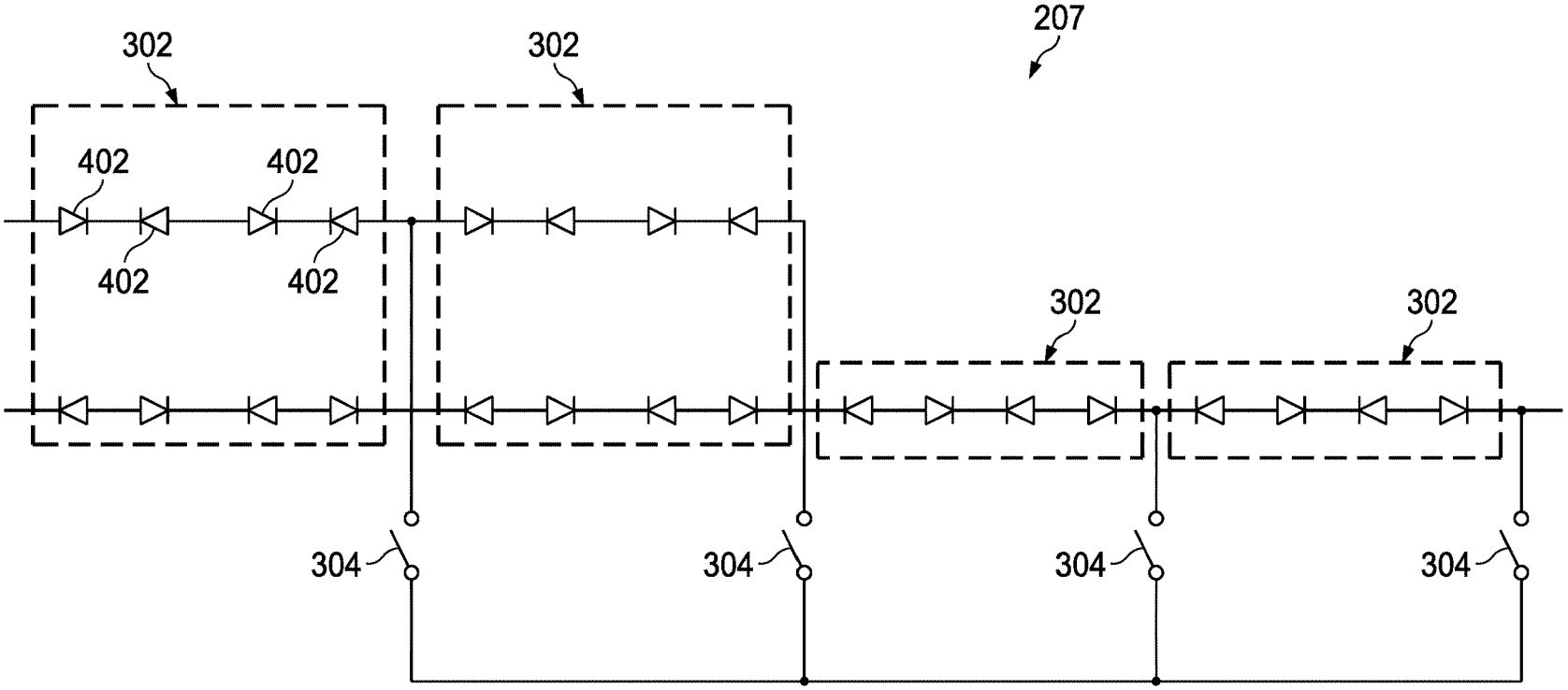
FIGS. 4A and 4B each illustrate a circuit diagram of example implementations of the variable bias resistor depicted in FIG. 3, in accordance with embodiments of the present disclosure.
Figure 4B:
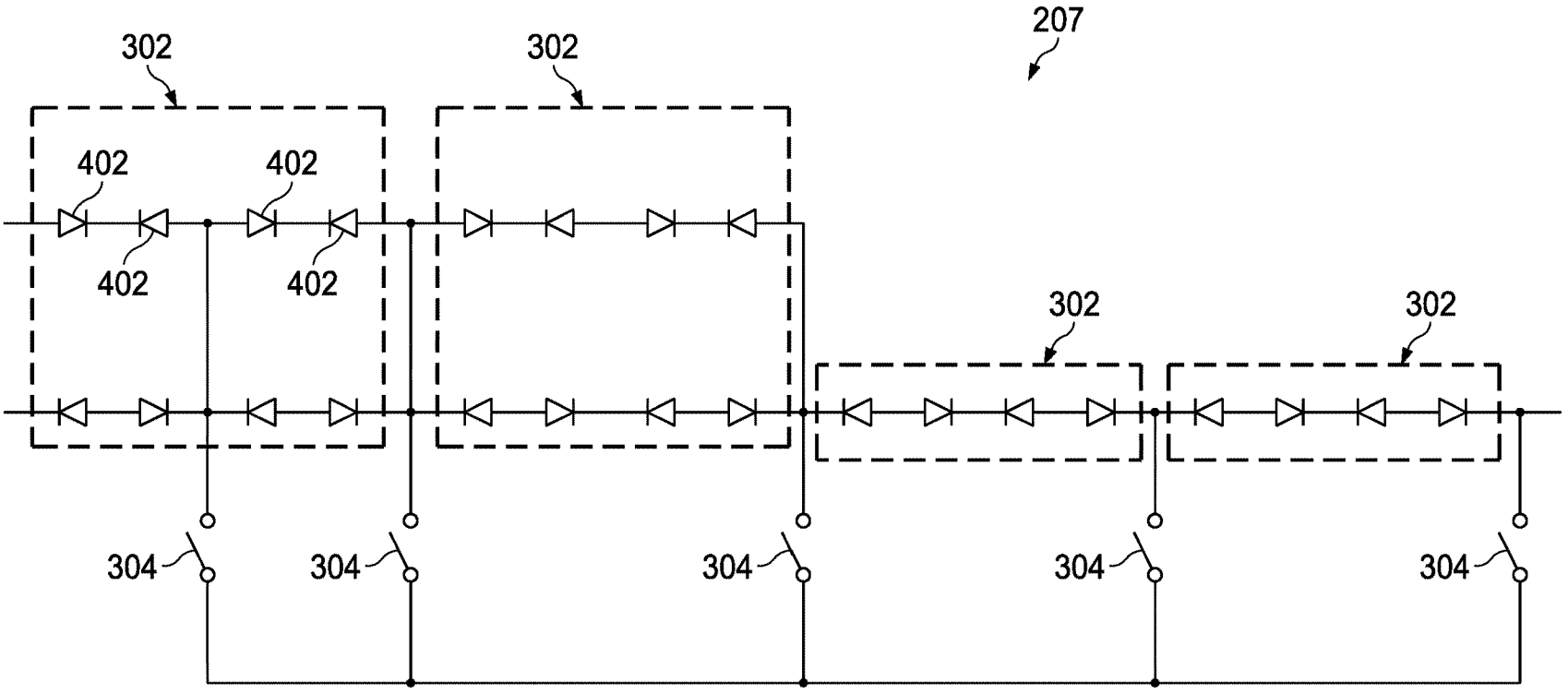

FIGS. 4A and 4B each illustrate a circuit diagram of example implementations of the variable bias resistor depicted in FIG. 3, in accordance with embodiments of the present disclosure. As shown in FIGS. 4A and 4B, each switched resistor element 302 of variable bias resistor 207 may be implemented by a plurality of back-to-back poly diodes 402 arranged as shown in FIG. 4A, arranged as shown in FIG. 4B, or arranged in any other suitable manner.

Although the foregoing discussion contemplates use of a microphone transducer in an audio system, the systems and methods discussed herein may be applied to provide electrical biasing to any other suitable capacitive sensor for measuring any physical quantity in any type of electrical circuit.

The methods and systems disclosed herein may provide one or more advantages over traditional approaches. For example, the systems and methods described herein may overcome a need for a high-pass filter interfaced between an output of a microphone transducer and a pre-amplifier, as discussed in the Background section of the present application.

As used herein, when two or more elements are referred to as "coupled" to one another, such term indicates that such two or more elements are in electronic communication or mechanical communication, as applicable, whether connected indirectly or directly, with or without intervening elements.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

All examples and conditional language recited herein are intended for pedagogical objects to aid the reader in understanding the disclosure and the concepts contributed by the inventor to furthering the art, and are construed as being without limitation to such specifically recited examples and conditions. Although embodiments of the present disclosure have been described in detail, it should be understood that various changes, substitutions, and alterations could be made hereto without departing from the spirit and scope of the disclosure.

What is claimed is:

1. A bias circuit for a capacitive sensor comprising:

a variable impedance element coupled to a capacitor of the capacitive sensor wherein an impedance of the variable impedance element is varied in accordance with a temperature associated with the bias circuit; and an active feedback circuit coupled between the variable impedance element and an output of a processing circuit for processing a signal generated by the capacitive sensor and configured to drive the variable impedance element to force a direct-current (DC) voltage level of an output of the capacitive sensor to a desired voltage.

2. The bias circuit of claim 1, wherein the capacitive sensor comprises a microphone.

3. The bias circuit of claim 1, wherein the capacitive sensor comprises a microelectromechanical systems microphone.

4. The bias circuit of claim 1, wherein the variable impedance element comprises a variable resistor and a resistance of the variable resistor is varied in accordance with the temperature associated with the bias circuit.

5. The bias circuit of claim 4, wherein the variable resistor comprises a plurality of switched resistor elements.

6. A method comprising:

varying, in accordance with a temperature associated with a bias circuit, an impedance of a variable impedance element coupled to a capacitor of a capacitive sensor, wherein the variable impedance element is integral to the bias circuit for biasing the capacitive sensor; and driving the variable impedance element with an active feedback circuit coupled between the variable impedance element and an output of a processing circuit for processing a signal generated by the capacitive sensor in order to force a direct-current (DC) voltage level of an output of the capacitive sensor to a desired voltage.

7. The method of claim 6, wherein the capacitive sensor comprises a microphone.

8. The method of claim 6, wherein the capacitive sensor comprises a microelectromechanical systems microphone.

9. The method of claim 6, wherein the variable impedance element comprises a variable resistor and varying the impedance comprises varying a resistance of the variable resistor in accordance with the temperature associated with the bias circuit.

10. The method of claim 9, wherein the variable resistor comprises a plurality of switched resistor elements.

11. An integrated circuit comprising:

a capacitive sensor configured to vary a capacitance of the capacitive sensor in conformity with a measured physical quantity;

a processing circuit for processing a signal generated by the capacitive sensor representative of the capacitance; and a bias circuit for electrically biasing the capacitive sensor, the bias circuit comprising:

a variable impedance element coupled to a capacitor of the capacitive sensor wherein an impedance of the variable impedance element is varied in accordance with a temperature associated with the bias circuit; and an active feedback circuit coupled between the variable impedance element and an output of the processing circuit and configured to drive the variable impedance element to force a direct-current (DC) voltage level of an output of the capacitive sensor to a desired voltage.

12. The integrated circuit of claim 11, wherein the capacitive sensor comprises a microphone and the measured physical quantity comprises a sound pressure incident upon the microphone.

13. The integrated circuit of claim 11, wherein the capacitive sensor comprises a microelectromechanical systems microphone and the measured physical quantity comprises a sound pressure incident upon the microelectromechanical systems microphone.

14. The integrated circuit of claim 11, wherein the variable impedance element comprises a variable resistor and a resistance of the variable resistor is varied in accordance with the temperature associated with the bias circuit.

15. The integrated circuit of claim 14, wherein the variable resistor comprises a plurality of switched resistor elements.

* * * * *